US010106227B2

(12) United States Patent
Allender

(10) Patent No.: US 10,106,227 B2
(45) Date of Patent: Oct. 23, 2018

(54) BULWARK TERRACE WITH INTEGRATED DOOR

(71) Applicant: Alexander Marine International Co., Limited, Hong Kong (CN)

(72) Inventor: Richard Corley Allender, Houston, TX (US)

(73) Assignee: Alexander Marine International Co., Limited, Hong Kong (CN)

( * ) Notice: Subject to any disclaimer, the term of this patent is extended or adjusted under 35 U.S.C. 154(b) by 0 days.

(21) Appl. No.: 15/680,130

(22) Filed: Aug. 17, 2017

(65) Prior Publication Data

US 2018/0057111 A1 Mar. 1, 2018

Related U.S. Application Data

(60) Provisional application No. 62/382,109, filed on Aug. 31, 2016.

(51) Int. Cl.

| | |
|---|---|
| ***B63B 3/48*** | (2006.01) |
| ***B63B 27/14*** | (2006.01) |
| ***B63B 17/04*** | (2006.01) |
| ***B63B 19/00*** | (2006.01) |
| *B63B 35/00* | (2006.01) |

(52) U.S. Cl.

CPC ..... *B63B 3/48* (2013.01); *B63B 17/04* (2013.01); *B63B 19/00* (2013.01); *B63B 27/146* (2013.01); *B63B 2027/141* (2013.01); *B63B 2035/004* (2013.01); *B63B 2707/00* (2013.01)

(58) Field of Classification Search

CPC .. B63B 3/48; B63B 7/04; B63B 7/082; B63B 7/085; B63B 17/00; B63B 17/04; B63B 19/00; B63B 19/08; B63B 27/00; B63B 27/14; B63B 27/146

USPC ..... 114/117, 362, 364

See application file for complete search history.

(56) References Cited

U.S. PATENT DOCUMENTS

| | | | | |
|---|---|---|---|---|
| 5,537,949 | A | 7/1996 | Blevins et al. | |
| 5,915,328 | A * | 6/1999 | Rowan | B63B 27/146 114/362 |
| 7,004,101 | B1 * | 2/2006 | Mardikian | B63B 19/08 114/362 |
| 8,752,499 | B2 * | 6/2014 | De Basto | B63B 3/48 114/362 |

(Continued)

FOREIGN PATENT DOCUMENTS

| | | |
|---|---|---|
| WO | 2013/036940 | 3/2013 |

OTHER PUBLICATIONS

Extended European Search Report dated Jan. 8, 2018, in Application No. 17187332.6.

(Continued)

*Primary Examiner* — Lars A Olson

(74) *Attorney, Agent, or Firm* — Weaver Austin Villeneuve & Sampson LLP

(57) ABSTRACT

A bulwark terrace with integrated door is provided; the bulwark terrace may be a portion of a bulwark on a ship or yacht that is hinged so as to be able to fold outwards and downwards and be flush with the deck after doing so, thereby extending the deck surface. The bulwark terrace may also include a door that may open independently of the bulwark terrace to allow boarding of the yacht or ship through the bulwark without deploying the bulwark terrace.

20 Claims, 13 Drawing Sheets

(56) References Cited

U.S. PATENT DOCUMENTS

| | | | | |
|---|---|---|---|---|
| 8,800,470 | B1 * | 8/2014 | Cummings | B63B 7/082 114/362 |
| 9,032,895 | B2 | 5/2015 | Buck | |
| 9,120,540 | B1 * | 9/2015 | Foss | B63B 27/146 |
| 9,193,417 | B2 * | 11/2015 | de Basto | B63B 3/48 |
| 9,334,023 | B2 | 5/2016 | Admire | |
| 2010/0170430 | A1 * | 7/2010 | Gros | B63B 19/08 114/362 |
| 2013/0025524 | A1 | 1/2013 | Cooney | |

OTHER PUBLICATIONS

"Balcony," Besenzoni, downloaded from the internet Aug. 24, 2016, 2 pgs.
"Bulwark Terrace," Besenzoni, downloaded from the internet Aug. 24, 2016, 2 pgs.
Weiss, C.C. "Expanding yacht increases sun-soaked lounging and swimming enjoyment," New Atlas, downloaded from the internet Aug. 24, 2016, 6 pgs.

* cited by examiner

BULWARK TERRACE WITH INTEGRATED DOOR

CROSS-REFERENCE TO RELATED APPLICATION

This application claims benefit of priority under 35 U.S.C. § 119(e) to U.S. Provisional Patent Application No. 62/382,109, filed Aug. 31, 2016, and titled "BULWARK TERRACE WITH INTEGRATED DOOR," which is hereby incorporated by reference herein in its entirety.

BACKGROUND

This disclosure relates to bulwark terraces and their actuation mechanisms, as found on yachts and other seafaring vessels.

Yachts and other seafaring vessels frequently include a "bulwark," which is a low wall that runs along at least part of the sides of the hull of such a vessel. The bulwark serves as a safety barrier that prevents people who are walking along the decks of the vessel from falling overboard. Most bulwarks are two to four feet in height, measured from the deck surface adjacent to the bulwarks, and sometimes also include a railing or guardrail along the top edge for aesthetic purposes or to provide an easy-to-grasp support for people to grab onto if they lose their balance, such as may happen in heavy swells.

In recent years, the luxury yacht market has seen the introduction of "bulwark terraces." A bulwark terrace is a section of bulwark on a boat that is mounted on a pivot or hinge with a rotational axis below the level of the deck to allow the bulwark section to pivot downwards and outwards, much like a drawbridge. When fully deployed, the "interior wall" of the bulwark section, i.e., the surface of the bulwark section that faces towards the centerline of the boat (which may also be referred to as an "inboard surface," as compared with the "outboard surface" or "exterior wall" or "exterior surface" of the bulwark section, i.e., the surface of the bulwark section that faces away from the centerline of the boat) and is nominally vertical when the bulwark section is not deployed, becomes nominally horizontal and is generally flush or level with the deck, thereby extending the deck area. In effect, the bulwark section becomes a balcony or terrace extension of the deck area, thereby increasing total available deck area of the boat and providing enhanced entertainment options. After a bulwark terrace is deployed, safety railings may optionally be installed around the perimeter of the bulwark terrace to reduce the chance of a person falling overboard off the bulwark terrace. During choppy seas, transit, or when the boat is docked, the bulwark terrace may be raised into its stored position, thereby restoring the integrity/continuity of the bulwark and making the boat more seaworthy in rough seas or decreasing the beam of the boat to allow it to dock in a narrower berth.

Bulwark terraces are typically only found on larger luxury yachts, e.g., yachts that are larger than 100 feet in length, due to cost and packaging considerations associated with them.

SUMMARY

Details of one or more implementations of the subject matter described in this specification are set forth in the accompanying drawings and the description below. Other features, aspects, and advantages will become apparent from the description, the drawings, and the claims. The systems, methods, and devices of this disclosure each have several innovative aspects, no single one of which is solely responsible for the desirable attributes disclosed herein. Included among these aspects are at least the following implementations, although further implementations may be set forth in the detailed description or may be evident from the discussion provided herein. These and other implementations are described in further detail with reference to the Figures and the detailed description below.

In some implementations, a boat is provided. The boat may include a hull, a deck, a bulwark extending upwards from the deck and extending along a side of the hull, a bulwark terrace, a bulwark terrace hinge mechanism, a door, and a door hinge mechanism. The bulwark terrace may be a section of the bulwark that is movable relative to a section or sections of the bulwark adjoining the bulwark terrace and the bulwark terrace hinge mechanism may be configured to allow the bulwark terrace to be pivoted about a terrace hinge axis relative to the section or sections of the bulwark adjoining the bulwark terrace. The bulwark terrace may also have a door cutout sized to receive the door, and the door hinge mechanism may be configured to allow the door to be pivoted about a door hinge axis relative to the bulwark terrace and between an open configuration and a closed configuration. The door, in the closed configuration, may be positioned in the door cutout, and, in the open configuration, may not be positioned in the door cutout.

In some further such implementations, the door hinge axis and the terrace hinge axis, when viewed along a vector defining the shortest distance between the door hinge axis and the terrace hinge axis, may define an angle of between 70° and 90°.

In some further implementations, the bulwark terrace hinge mechanism may have a first limit of rotation about the terrace hinge axis and a second limit of rotation about the terrace hinge axis. The first limit of may limit the amount of rotation of the bulwark terrace in a first direction, and the second limit of rotation may limit the amount of rotation of the bulwark terrace in a second direction opposite the first direction. The bulwark terrace may have an inboard surface that is flush with the deck when the bulwark terrace reaches the first limit of rotation, and an outboard surface that is flush with an outboard surface or surfaces of the section or sections of the bulwark adjoining the bulwark terrace when the bulwark terrace reaches the second limit of rotation.

In some implementations of the boat, the door may include a telescoping ladder housed within the door. The telescoping ladder may be configured to deploy from a surface of the door that faces upwards when door is in the closed configuration and the bulwark terrace is at the second limit of rotation; this surface may also face outboard when the bulwark terrace is at the first limit of rotation.

In some implementations of the boat, the door, when in the closed configuration, may have a width in a direction perpendicular to the door hinge axis and generally parallel to the terrace hinge axis, and the door cutout may be set off from an end of the bulwark terrace closest to the door hinge mechanism by a distance greater than the width of the door and in a direction parallel to the terrace hinge axis.

In some implementations of the boat, the door hinge axis and the terrace hinge axis may be substantially parallel.

In some implementations of the boat, the door may include one or more of molded handholds, molded footholds, or a fold-out ladder.

In some implementations of the boat, the door hinge axis and the terrace hinge axis may be within ±20° of parallel.

In some implementations of the boat, the door may be configured to pivot inwards and towards a centerline of the boat when the door is moved from the closed configuration to at least a first open position.

In some implementations of the boat, the door may be configured to pivot outwards and away from a centerline of the boat when the door is moved from a closed position to at least a first open position.

In some implementations of the boat, the door cutout may form a generally rectangular notch in the bulwark terrace.

In some implementations of the boat, the door cutout may form a generally rectangular hole in the bulwark terrace.

In some implementations, a bulwark terrace assembly is provided that includes a bulwark terrace hinge mechanism, a bulwark terrace, a door, and a door hinge mechanism. The bulwark terrace hinge mechanism may include one or more stationary mounting features, the bulwark terrace may be connected with the bulwark terrace hinge mechanism such that the bulwark terrace is rotatable about a terrace hinge axis relative to the stationary mounting features, the bulwark terrace may have a door cutout sized to receive the door, the door hinge mechanism may be configured to allow the door to be pivoted about a door hinge axis relative to the bulwark terrace and between an open configuration and a closed configuration, the door, in the closed configuration, may be positioned in the door cutout, and the door, in the open configuration, may not be positioned in the door cutout.

In some implementations of the bulwark terrace assembly, the door hinge axis and the terrace hinge axis, when viewed along a vector defining the shortest distance between the door hinge axis and the terrace hinge axis, may define an angle of between 70° and 90°.

In some implementations of the bulwark terrace assembly, the bulwark terrace may have a first limit of rotation about the terrace hinge axis and a second limit of rotation about the terrace hinge axis, the first limit of rotation may limit the amount of rotation of the bulwark terrace relative to the stationary mounting features in a first direction, and the second limit of rotation may limit the amount of rotation of the bulwark terrace relative to the stationary mounting features in a second direction opposite the first direction. The first limit of rotation may be associated with a deployed configuration of the bulwark terrace, the second limit of rotation may be associated with a stowed configuration of the bulwark terrace, and the bulwark terrace may rotate through an arc of between 70° and 120° when transitioning between the first limit of rotation and the second limit of rotation.

In some implementations of the bulwark terrace assembly, the bulwark terrace and the door may have inboard surfaces that face the fore-aft centerline of a boat when the bulwark terrace assembly is installed in the boat, the bulwark terrace is in the stowed configuration, and the door is in the closed configuration, and the door may be configured to pivot such that the inboard surface of the door and the inboard surface of the bulwark terrace face each other when the bulwark terrace is in the stowed configuration and the door is in the open configuration.

In some implementations of the bulwark terrace assembly, the bulwark terrace and the door may have outboard surfaces that face away from the fore-aft centerline of a boat when the bulwark terrace assembly is installed in the boat, the bulwark terrace is in the stowed configuration, and the door is in the closed configuration, and the door may be configured to pivot such that the outboard surface of the door faces and the outboard surface of the bulwark terrace face each other when the bulwark terrace is in the stowed configuration and the door is in the open configuration.

In some implementations of the bulwark terrace assembly, the door, when in the closed configuration, may have a width in a direction perpendicular to the door hinge axis and generally parallel to the terrace hinge axis, and the door cutout may be set off from an end of the bulwark terrace closest to the door hinge mechanism by a distance greater than the width of the door and in a direction parallel to the terrace hinge axis.

In some implementations of the bulwark terrace assembly, the door cutout may form a generally rectangular notch in the bulwark terrace.

In some implementations of the bulwark terrace assembly, the door cutout may form a generally rectangular hole in the bulwark terrace.

BRIEF DESCRIPTION OF THE DRAWINGS

in FIG. 10, the bulwark terrace and select other components are shown transparently to allow features normally hidden from view to be seen.

These Figures are intended to be illustrative only and should not be viewed as limiting this disclosure to only the depicted implementations. It is to be understood that the concepts discussed herein may be implemented in a number of different ways while still embodying the ideas discussed herein, and it is to be understood that this disclosure covers such alternative implementations.

DETAILED DESCRIPTION

Discussed herein are new bulwark terrace designs that offer significant advantages over existing bulwark terrace hardware. Importantly, the concepts discussed herein may be particularly well-suited to implementation in smaller luxury yachts, e.g., in the 30 foot to 100 foot range, although it is to be recognized that the concepts discussed herein may also be implemented on boats or ships of other sizes. Bulwark terraces have, until now, typically been unsuited to being integrated into smaller luxury yachts due to space considerations.

Figure 1:
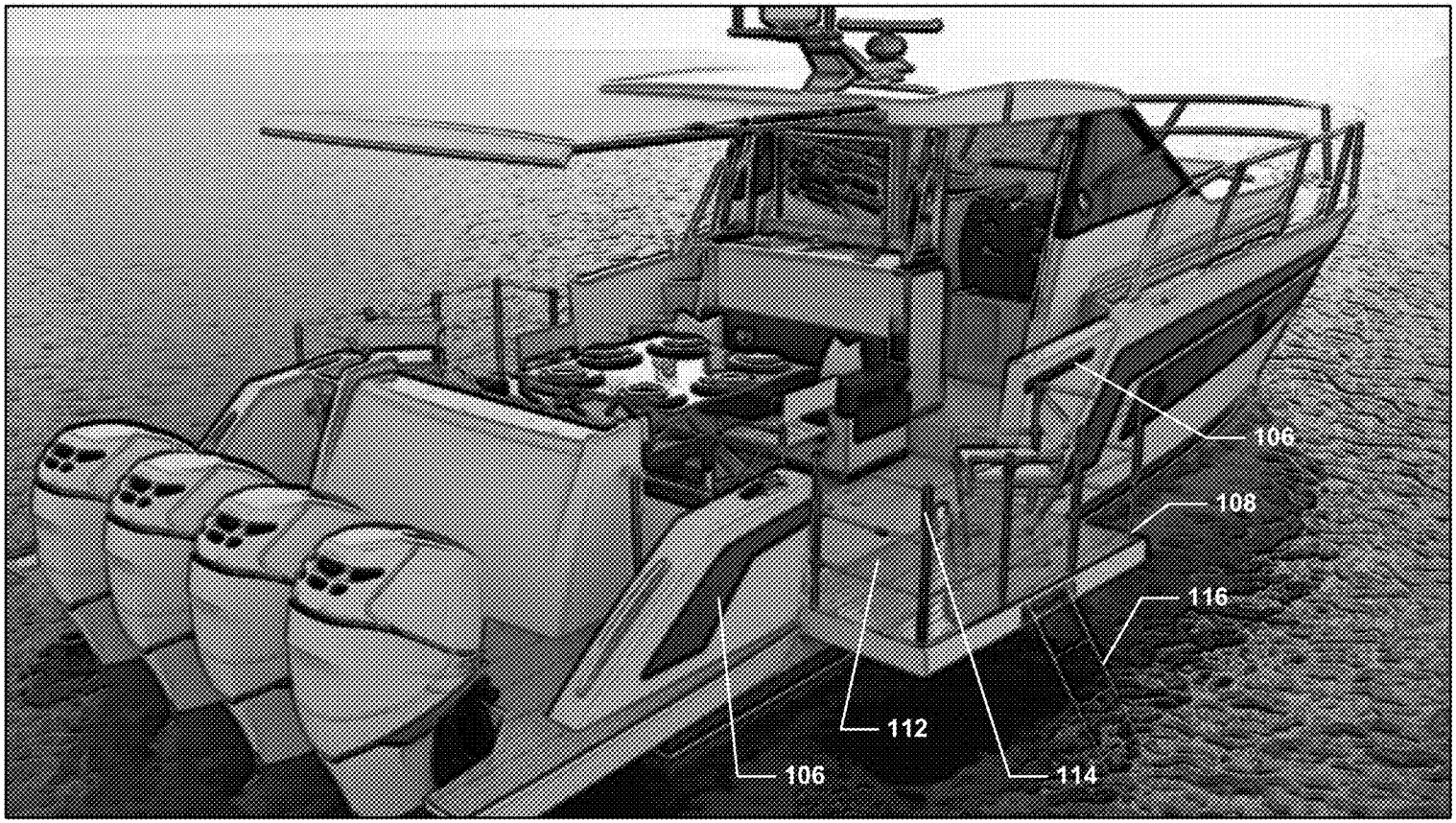
FIG. 1 depicts a picture of an example motor yacht with an example of deployed bulwark terraces.

FIG. 1 depicts a picture of an example motor yacht with an example of deployed bulwark terraces. As can be seen, the yacht that is depicted has bulwarks 106 that start just aft of the wheelhouse and extend all the way through the aft passenger deck area. Two sections of the bulwarks 106 (the other is not called out, but is located on the opposite side of the yacht), i.e., bulwark terraces 108, are hinged and may pivot outwards and downwards so as to extend the area of the deck 112. Safety railings 114 may be installed, if desired, and a boarding ladder 116 may also optionally be connected to the outer edge of the bulwark terrace 108 to facilitate swimmer's or diver's egress from the water back into the yacht.

Figure 2:
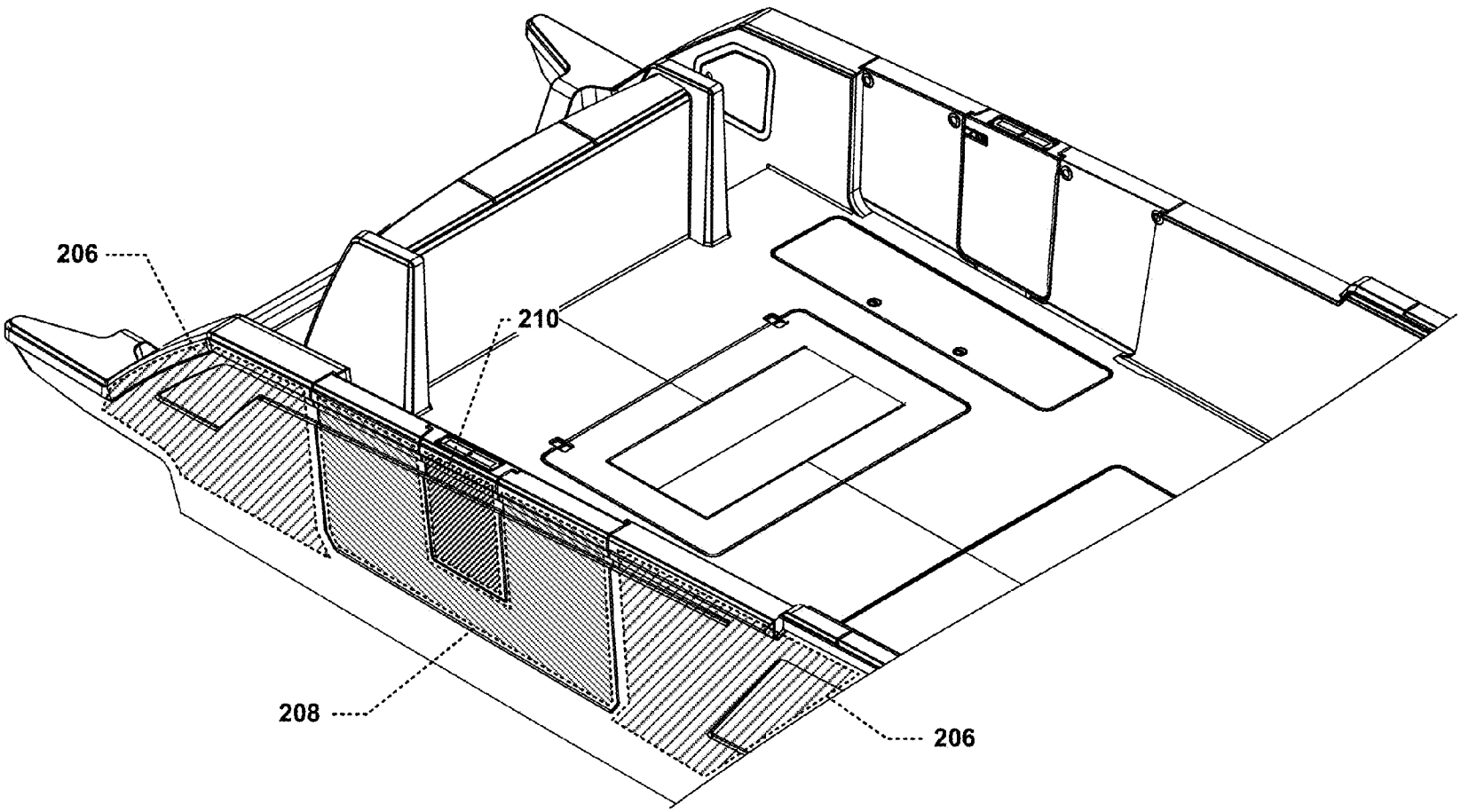
FIG. 2 depicts a detail view of the stern of a motor yacht similar to the example motor yacht of FIG. 1 with the bulwark terraces in the stowed or raised position.

FIG. 2 depicts a detail view of the stern of an example motor yacht similar to the example motor yacht of FIG. 2, but with bulwark terraces in the stowed or raised position. As can be seen, the bulwark terraces 208 extend along significant portions, e.g., ~50%, of the bulwarks 206. One key feature of the depicted bulwark terraces 208 is that the bulwark terraces 208 include, within themselves, doors 210. The function and purpose of the doors 210 is discussed in more detail below.

Figure 3:
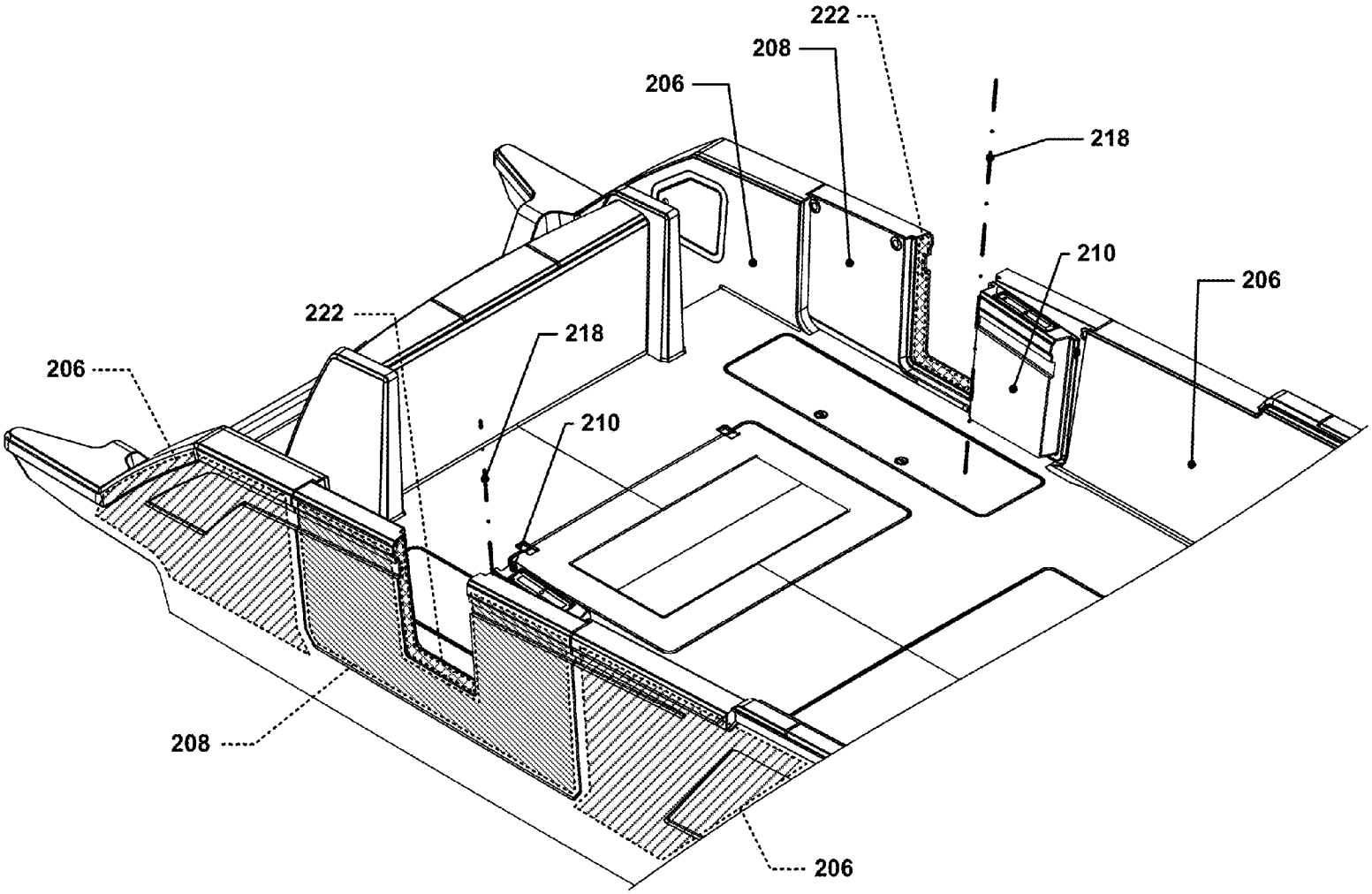
FIG. 3 depicts a detail view of the stern of the example motor yacht of FIG. 2 with the doors located in the bulwark terraces open.

FIG. 3 depicts a detail view of the example motor yacht of FIG. 2 with the doors 210 in a completely open position. The doors 210 are connected to the bulwark terraces by door hinge mechanisms, e.g., piano hinges or other suitable devices, that allow the doors 210 to pivot about door hinge axes 218 that are generally vertical in orientation and generally orthogonal to the axis about which the bulwark terrace 208 pivots (referred to herein as the "terrace hinge axis"). For example, the door hinge axis 218 may be at an angle of 90° with respect to the terrace hinge axis when viewed along a vector that defines the shortest distance between these two axes (in the case where the two axes actually intersect, this is a zero length vector, but it is to be understood that in this particular circumstance, the vector is to be considered as being perpendicular to the plane that is coincident with both axes). It is to be understood that the door hinge axis 218 may be vertical when the boat is stationary, i.e., not bobbing on ocean swell, but may also be somewhat tilted, e.g., if the bulwarks 206 are constructed so as to flare slightly outwards, the door hinge axis may be aligned to match such an angle. A slight angle may also be introduced in the hinge axis to cause gravity to induce a rotational torque on the doors 210 to cause the doors 210 to be rotationally biased so as to naturally swing into a closed position in the absence of any other outside forces when the boat is level. In fact, due to manufacturing variations or to such design considerations, the angle between the door hinge axis 218 and the terrace hinge axis, as discussed above, may range from 90° to as low as 70°. It is to be understood that this angle refers to the smaller of the two supplementary angles (assuming that the angle is not exactly 90°) defined by the door hinge axis 218 and the terrace hinge axis when viewed from the perspective discussed above. It is to be understood that the angular range just discussed, while applicable to a large number of bulwark terrace/door combinations, may not be applicable to other implementations. For example, discussed below are bulwark terrace/door concepts that do not feature such an angular relationship between the door hinge axis and the terrace hinge axis (for example, implementations in which both axes are parallel or nearly parallel).

It is also to be understood that other configurations of a bulwark terrace having an integrated door are also considered within the scope of this disclosure. For example, in some implementations, a bulwark terrace may have a door that swings outwards instead of inwards (thus, for example, an inward-swinging door may swing open such that the inboard surface of the door faces the inboard surface of the adjacent bulwark terrace, whereas an outward-swinging door may swing open such that the outboard surface of the door faces the outboard surface of the bulwark terrace). In some other implementations, the door hinge axis may lie along a direction other than a generally vertical direction when the bulwark terrace is in the stowed position. For example, in some implementations, the door hinge axis may be generally parallel to the terrace hinge axis, and the door may open outwards. In such a configuration, the door may be configured to pivot outwards from the bulwark terrace by approximately 90° so that when the bulwark terrace is stowed and the door is opened, the door forms a mini-gangplank or diving platform. When such a bulwark terrace is deployed and the door within it is also opened, the door may extend downwards into or towards the water. Features such as handholds/footholds may be molded into the door or otherwise included in the door to allow a person to climb up or down the door and into or out of the boat when the door is in this position. Alternatively, the door may include a fold-out ladder that sits flush with the interior-facing surface of the door when the door and the bulwark terrace are both in the stowed or closed positions or when the bulwark terrace is in the stowed position and the door is in the open position (acting as a gangplank), but that pivots or extends outwards from the door when the door and the bulwark terrace are both in the deployed state.

Figure 11:
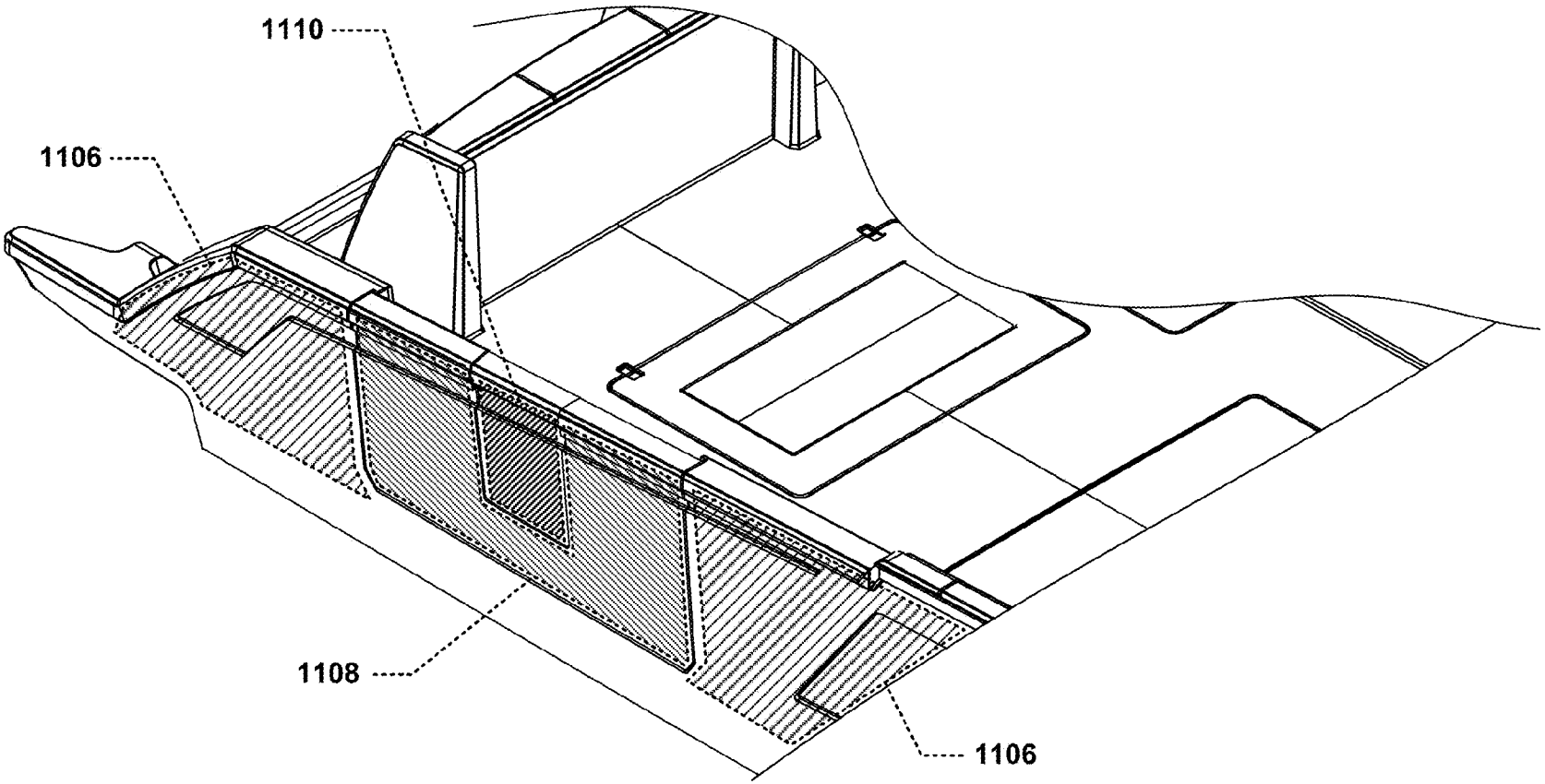
FIG. 11 depicts a detail view of the right stern portion of an example motor yacht similar to that of FIG. 1; the implementation of FIG. 11 features a different example implementation of a bulwark terrace with an integrated door.
Figure 12:
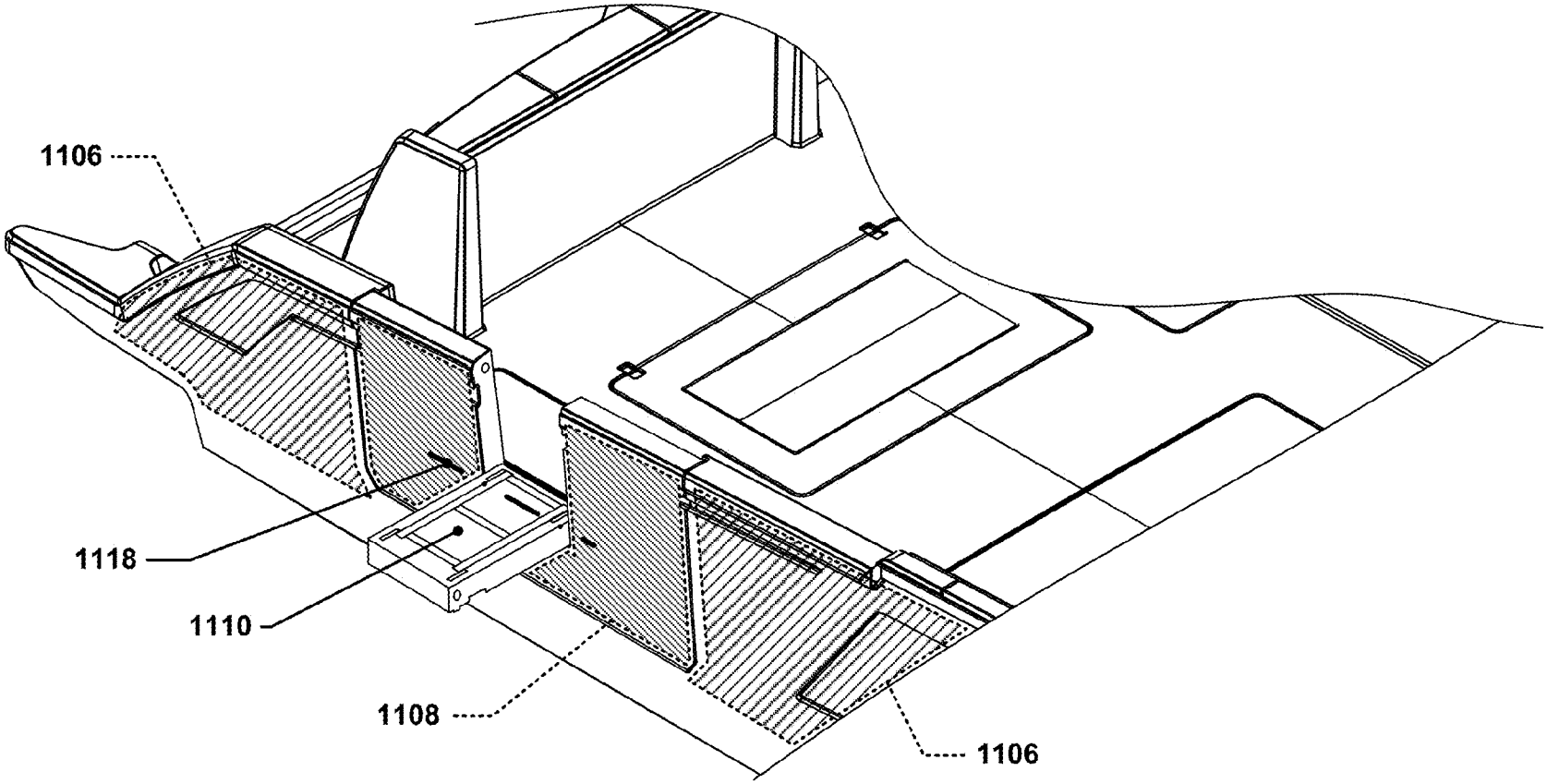
FIG. 12 depicts the right stern portion of the example motor yacht of FIG. 11 with the door located in the bulwark terrace in an open position; this door is hinged about an axis that is parallel to the terrace hinge axis.
Figure 13:
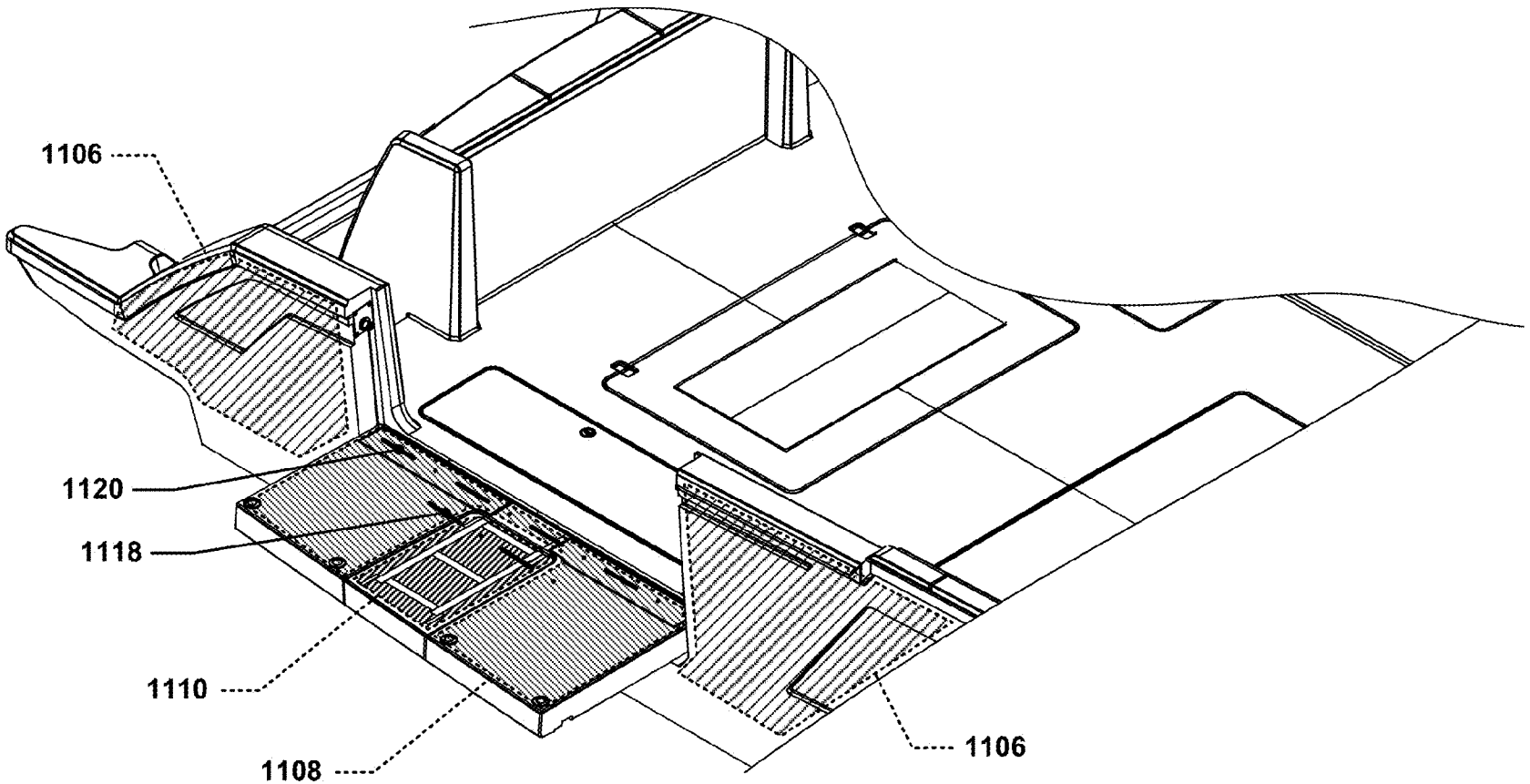
FIG. 13 depicts the right stern portion of the example motor yacht of FIG. 11 with the bulwark terrace in the deployed position and the door in the closed position.
Figure 14:
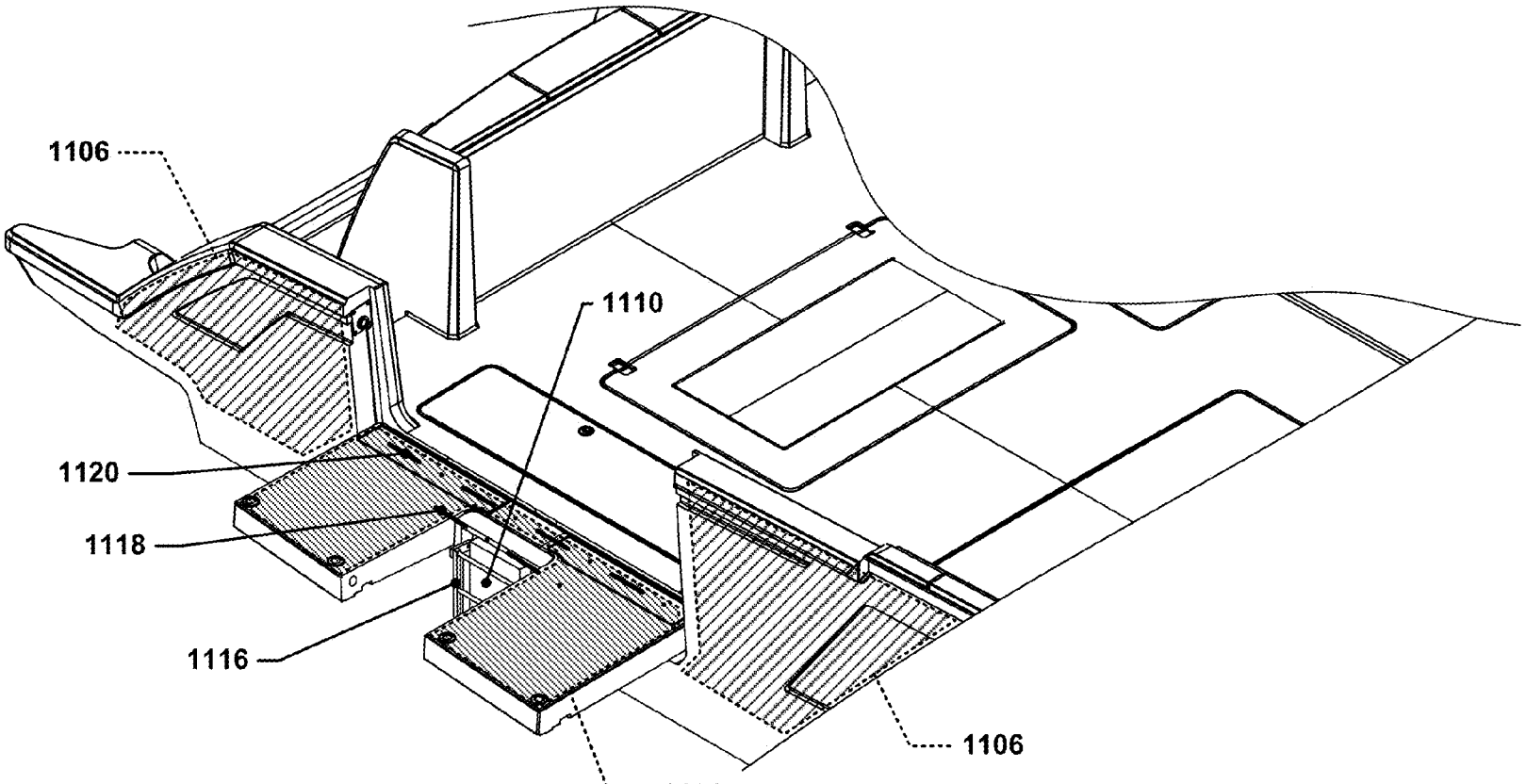
FIG. 14 depicts the right stern portion of the example motor yacht of FIG. 11 with both the bulwark terrace and the door in the deployed or open positions.

An example of such a door and bulwark terrace configuration is depicted in FIGS. 11 through 14. FIG. 11 depicts a detail view of the right stern portion of an example motor yacht similar to that of FIG. 1. In FIG. 11, a bulwark 1106 is shown that has a bulwark terrace 1108 that includes a door 1110. FIG. 12 depicts the right stern portion of the example motor yacht of FIG. 11 with the door located in the bulwark terrace in an open position. As can be seen, the door 1110 is configured to rotate about a door hinge axis 1118 and folds out like a drawbridge. FIG. 13 depicts the right stern portion of the example motor yacht of FIG. 11 with the bulwark terrace in the deployed position and the door in the closed position. The bulwark terrace 1108 in this implementation may rotate about a terrace hinge axis 1120 that is generally parallel to the door hinge axis 1118. FIG. 14 depicts the right stern portion of the example motor yacht of FIG. 11 with both the bulwark terrace and the door in the deployed or open positions. In this particular implementation, the door 1110 may have a fold-out boarding ladder 1116 that may be deployed when the door 1110 and the bulwark terrace 1108 are both deployed/open.

FIG. 11 depicts a detail view of an example motor yacht of FIG. 1; FIG. 11 is similar in appearance to Figure #BB, but considerably simplified. FIG. 12 depicts a detail view of the example motor yacht of FIG. 1 with a door located in one of the bulwark terraces in an open position; this door is hinged about an axis that is parallel to the terrace hinge axis. As can be seen, this door includes a fold-out ladder that may be used when the door and the bulwark terrace are both deployed/open. The fold-out ladder may otherwise be flush with the interior surface of the door, e.g., when the door is horizontal (as it would be when acting as a gangplank or as part of the deployed bulwark terrace). FIG. 13 depicts a detail view of the example motor yacht of FIG. 1 with the bulwark terrace in the deployed position and the door in the closed position. FIG. 14 depicts a detail view of the example motor yacht of FIG. 1 with both the bulwark terrace and the door in the deployed or open positions.

Regardless of the particular type of door used, the width of the door cutout may be sized to allow at least one adult person to walk through the door cutout, e.g., it may be at least 1 ft wide, between 1 and 1.5 feet wide, 1.5 feet to 2 feet wide, or more than 2 feet wide.

It is also to be understood that the door may, in some implementations, be entirely surrounded by the bulwark terrace, i.e., the door cutout may not have any "open" edges. For example, the door cutout may form a generally rectangular hole in the bulwark terrace, with the bulwark terrace bounding the rectangular hole on all four sides (as opposed to just three sides as would be the case with a U-shaped door cutout). In such cases, the term "hatch" may be used herein to indicate such a door. In some implementations, the door may swing upwards instead of downwards (as in FIGS. 11-14) or may, for example, be entirely removable, e.g., not connected with a door hinge mechanism, or connected via a door hinge mechanism that is releasable to allow the door to be easily removed. This latter approach may allow for the bulwark terrace to be deployed while allowing for an opening through which a person can enter or leave the water, but without having the door take up terrace space. The removed door may be stored elsewhere on the boat.

As can be seen, the bulwark terrace 208 has a door cutout 222 in it that is, generally speaking, a U-shaped or generally rectangular cutout (for example, a rectangular cutout with rounded lower corners). The door cutout 222 extends from the gunwale of the bulwark terrace 208 downwards. The "gunwale," in the context of this disclosure, refers to the uppermost surface of the bulwark 206 or the bulwark terrace 208 (when the bulwark terrace is in the raised or stowed configuration). This cutout may include, for example, a gasket (not shown) that runs along the cutout and that seals against the door 210 when the door 210 is closed. The gasket may prevent water from entering the boat when the door 210 is closed. Generally speaking, in many implementations, the door 210 may be slightly wider (along at least the bow-to-stern direction) on the side of the door 210 that faces the interior of the boat when the door 210 is closed than the opposite side of the door. Such an arrangement will cause the door 210 to "wedge" into place in the door cutout 222 when the interior surface of the door 210 has a load applied while the door 210 is in the closed position. Alternatively, the door may have a flange that is larger than the door cutout 222 (as shown in FIGS. 2 through 8) so that the flange prevents the door 210 from swinging or moving through/past the door cutout 222 in one direction, but permits it in the other direction. The door 210 may also include a latch mechanism that may keep the door 210 from opening unless released.

Figure 4:
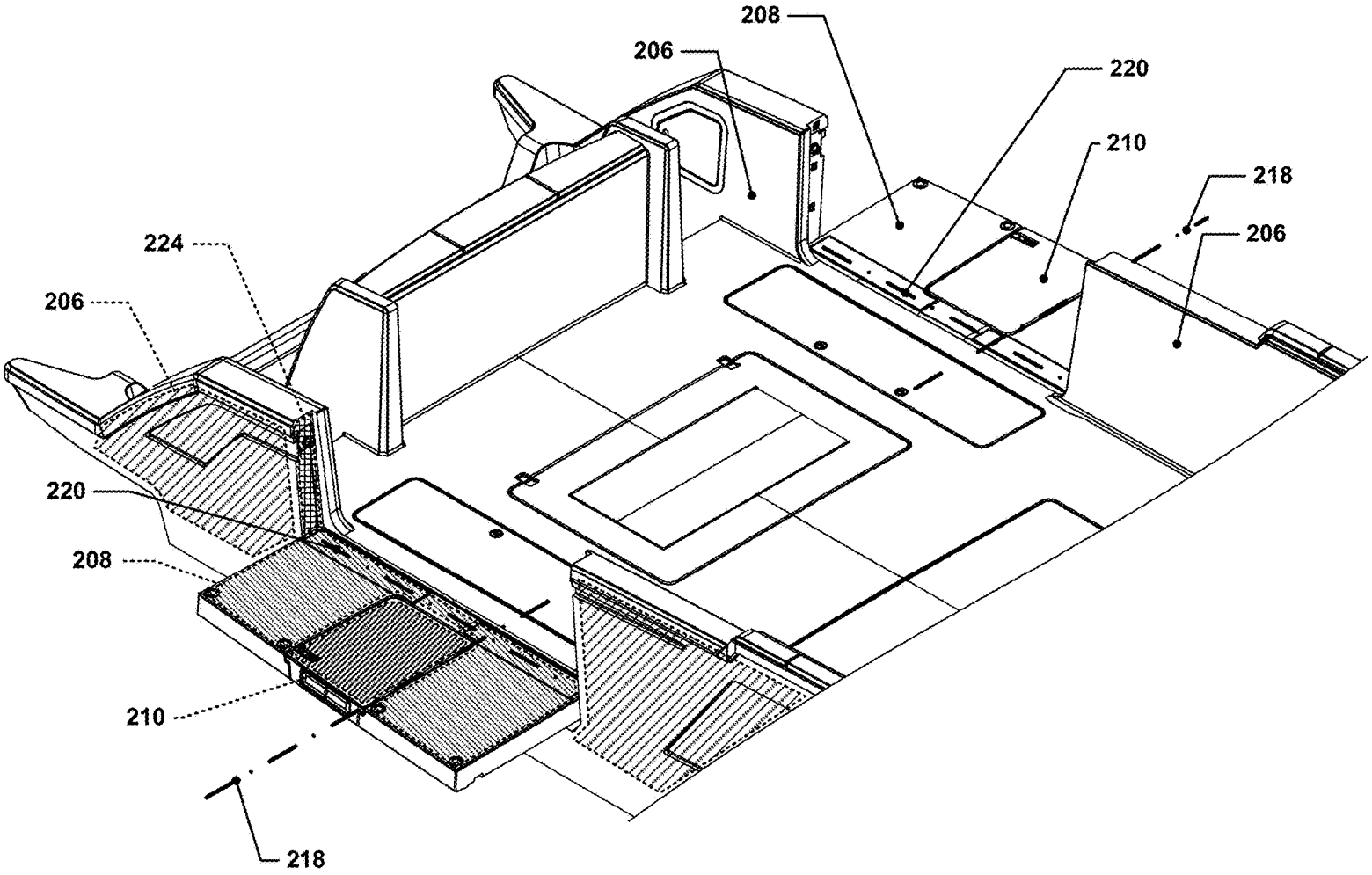
FIG. 4 depicts a detail view of the stern of the example motor yacht of FIG. 2 with the bulwark terraces in their fully deployed or lowered positions.
Figure 5:
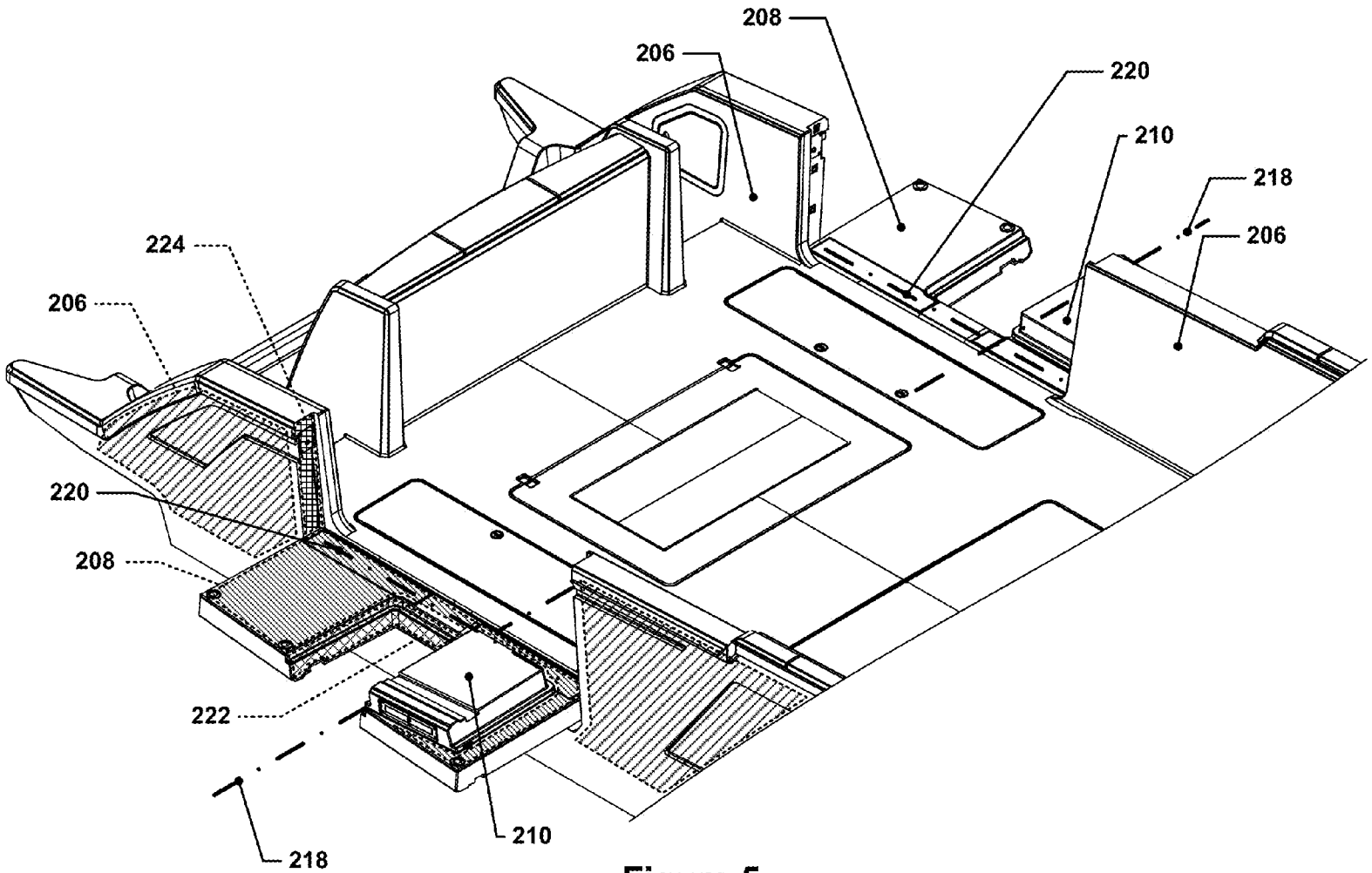
FIG. 5 depicts a detail view of the stern of the example motor yacht of FIG. 2 with the bulwark terraces in a fully deployed or lowered position and the doors in the open position; this configuration would likely not normally be seen during normal usage of the bulwark terrace.

FIG. 4 depicts a detail view of the example motor yacht of FIG. 2 with the bulwark terraces 208 in a fully deployed or lowered position and the doors 210 closed. As can be seen, the bulwark terraces 208 now extend the surface area of the deck. As indicated, the terrace hinge axis 220 is substantially orthogonal to the door hinge axis 218. The door 210 is fully closed in this state (it could also be opened while the bulwark terraces 208 are deployed, as shown in FIG. 5, but this would defeat much of the purpose of having the bulwark terraces 208 in the first place). It is to be understood that the door, in this embodiment, is configured to swing "inwards," i.e., towards the centerline of the boat, when opening, whereas the bulwark terrace is configured to swing "outwards," i.e., away from the centerline of the boat, when opening/deploying. Thus, the door and the bulwark terrace are hinged, in this case, so as to swing in opposite directions from one another. As was discussed earlier, however, other implementations of these concepts may feature doors that are configured to "open" in the same direction as the bulwark terrace. The door cutout 222 may, in some implementations, be offset along the terrace hinge axis from the end of the bulwark terrace 208 that is closest to the door hinge mechanism by a distance that is at least as large as the door 210 is wide (along the terrace hinge axis and when the door is in the closed configuration). This may allow the door to be open while the bulwark terrace is deployed without potentially colliding with the stationary bulwark sections.

Figure 6:
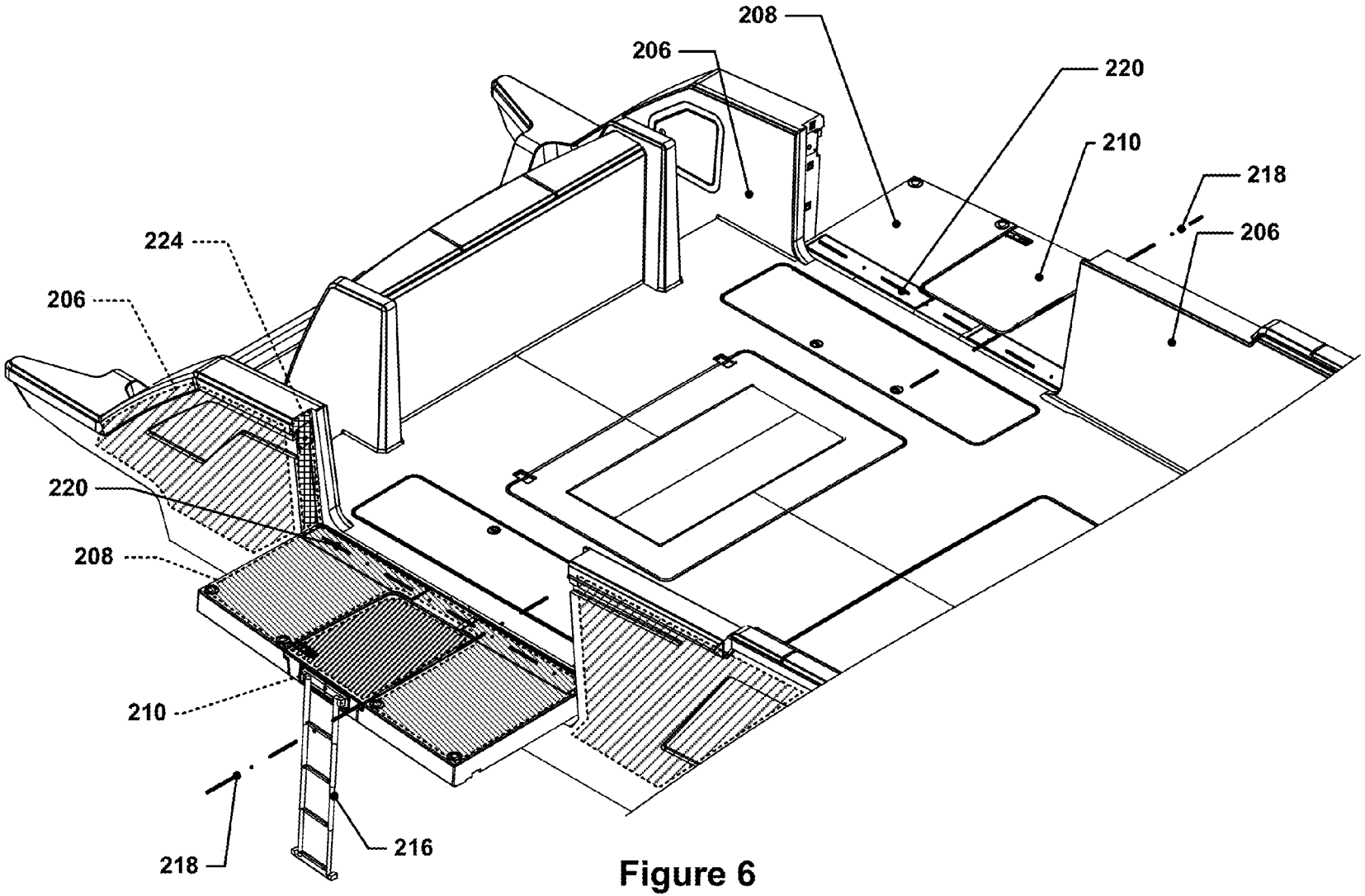
FIG. 6 depicts a detail view of the stern of the example motor yacht of FIG. 2 with the bulwark terraces in a fully deployed or lowered position, the doors in the closed position, and with a boarding ladder located in the door deployed.

FIG. 6 depicts a detail view of the stern of the example motor yacht of FIG. 2 with the bulwark terraces in a fully deployed or lowered position, the doors in the closed position, and with a boarding ladder located in one of the doors deployed. Such a configuration may be useful when passengers on the boat wish to, for example, dive off the sides of the boat in order to swim, while still maintaining the ability to climb back aboard via the ladder 216. The ladder in such an implementation may be located in the gunwale of the bulwark terrace 208 or, as shown in this case, the gunwale of the door 210. Such a ladder 216 may be a telescoping ladder or similar such device that may be collapsed into a much more compact form in order to be stored within the bulwark terrace 208 or the door 210.

Figure 7:
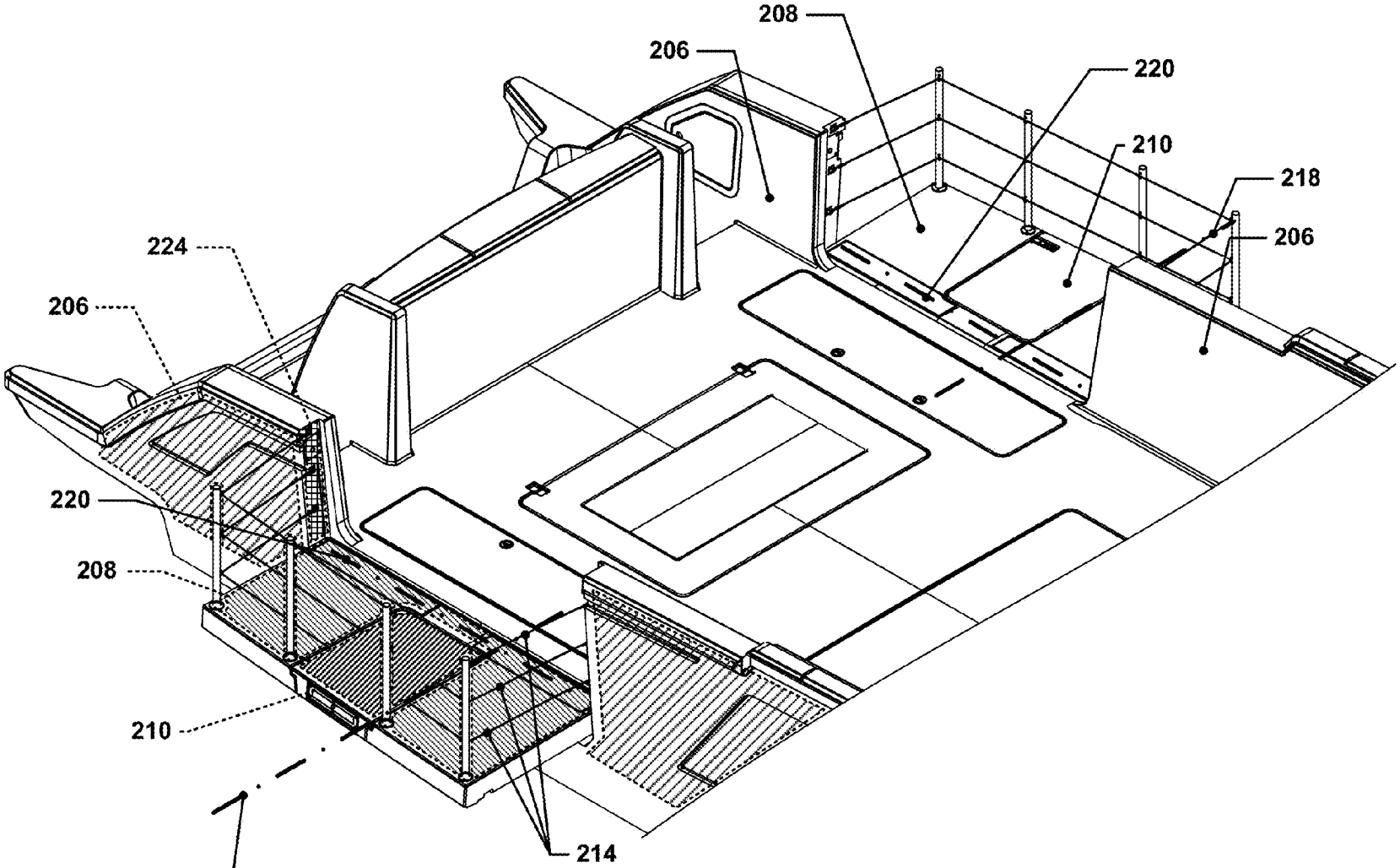
FIG. 7 depicts a detail view of the stern of the example motor yacht of FIG. 2 with the bulwark terraces in a fully deployed or lowered position, the doors in the closed position, and with railings installed around the periphery of the bulwark terraces.

FIG. 7 depicts a detail view of the stern of the example motor yacht of FIG. 2 with the bulwark terraces in a fully deployed or lowered position, the doors in the closed position, and with railings installed around the periphery of the bulwark terraces. In this configuration, the bulwark terraces 208 provide an extended deck surface area, and the railings 214 may prevent passengers from inadvertently falling off of the deployed bulwark terraces 208. The railings may be removable, e.g., a set of posts with cables fed through rings or other attachment points along the railings so that the cables may slide relative to the posts. The ends of the cables may be connected with anchors located along the portions of the bulwarks that butt up to the bulwark terrace 208 when in the stowed configuration, and the posts may be inserted into receptacles located in the bulwark terrace 208. When the railings are not in use, they may be stored within a storage compartment, e.g., the elongate storage compartments located in the deck just inboard of the bulwark terraces 208 (they are shown with the hatch doors closed).

Figure 8:
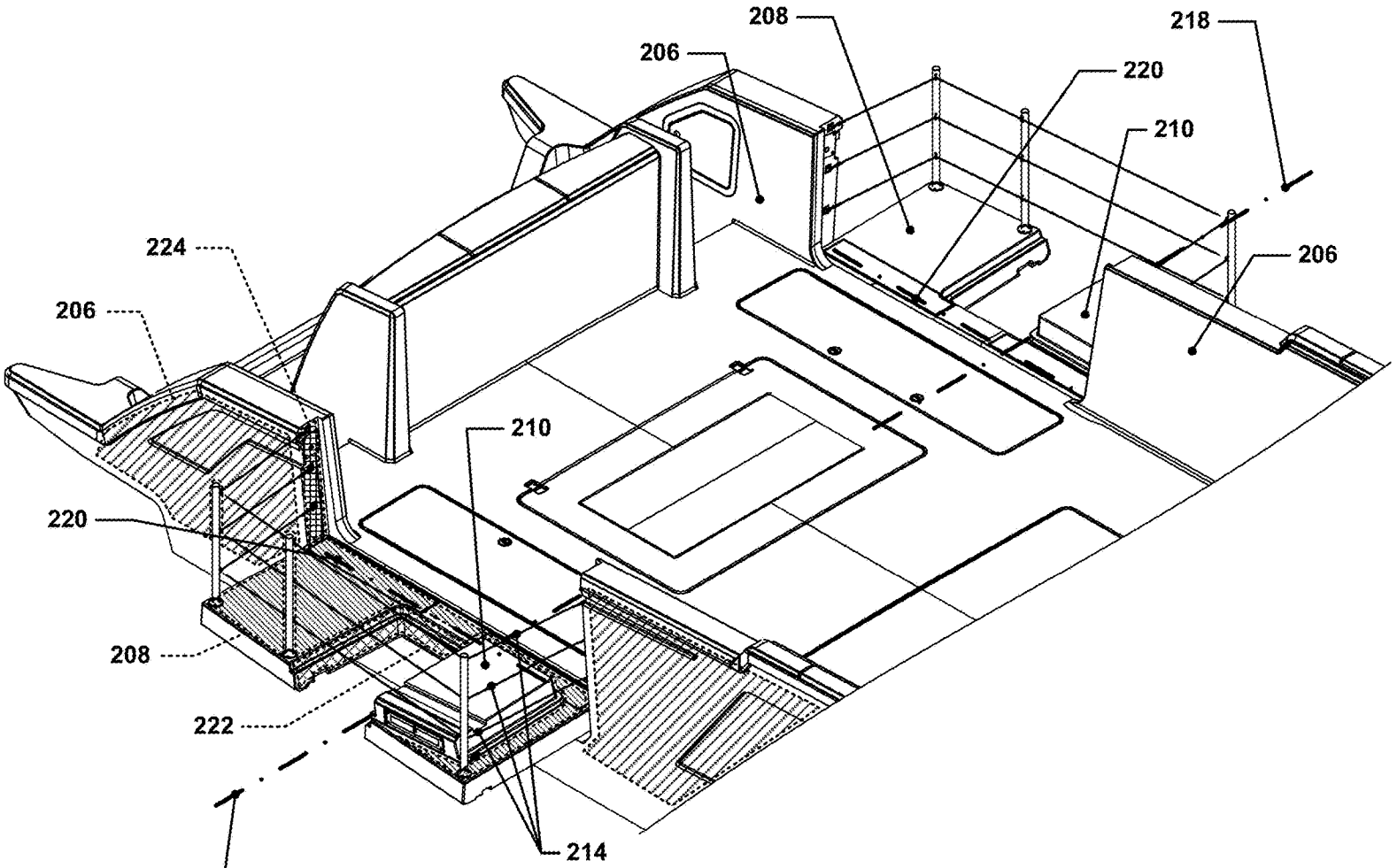
FIG. 8 depicts a detail view of the stern of the example motor yacht of FIG. 2 with the bulwark terraces in a fully deployed or lowered position, the doors in the open position, and with railings installed around the periphery of the bulwark terraces.

FIG. 8 depicts a detail view of the stern of the example motor yacht of FIG. 2 with the bulwark terraces in a fully deployed or lowered position, the doors in the open position, and with railings installed around the periphery of the bulwark terraces. Such a configuration may be used, for example, if a person wishes to fish through the open door 210 while the bulwark terrace 208 is deployed. In such a configuration, the railing 214 may still be used, but may be equipped with one less post (to skip the post receptacle that is obstructed by the open door 210). In other such implementations, the bulwark terrace 208 may include one or more "extra" post receptacles located at positions that are not obstructed by the door 210 when open; these extra post receptacles may be used to receive the posts that would normally be inserted into any obstructed post receptacles. Thus, the total number of post receptacles in the bulwark terrace 208 may be larger than the total number of posts in a railing set.

Figures 9, 10:
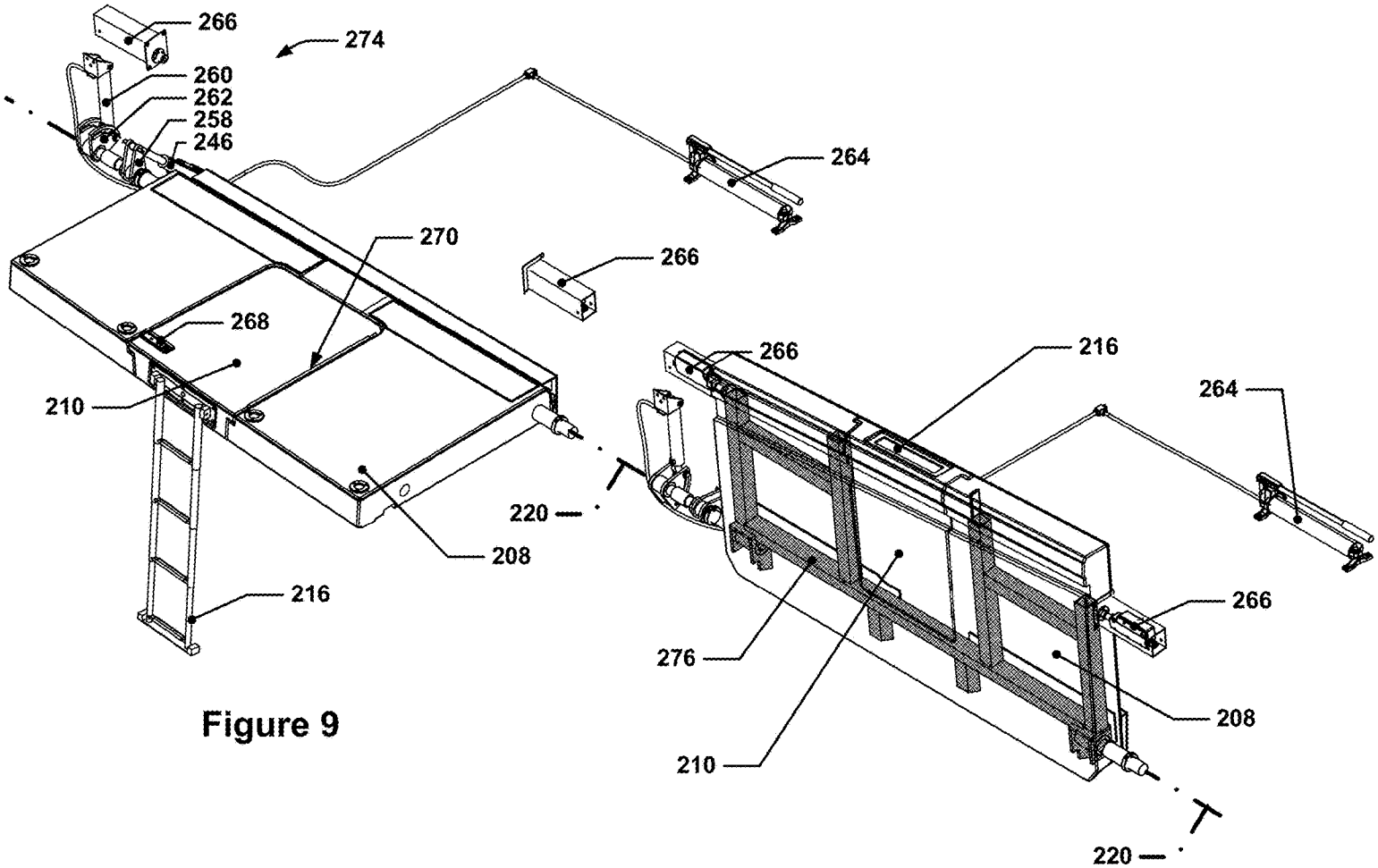
FIGS. 9 and 10 depict one of the example bulwark terraces of FIGS. 2 through 8 in the deployed and stowed configurations, respectively, but without the remainder of the boat shown.

FIGS. 9 and 10 depict one of the example bulwark terraces of FIGS. 2 through 8 in the deployed and stowed configurations, respectively, but without the remainder of the boat shown; in FIG. 10, the bulwark terrace and select other components are shown transparently to allow features normally hidden from view to be seen.

As shown in FIGS. 9 and 10, the bulwark terrace 208 may be mounted to a terrace hinge mechanism 274. The terrace hinge mechanism 274, for example, may include a rotational shaft that is rigidly connected with an interior framework 276 (see FIG. 10) and supported by bearing blocks (not shown). The bearing blocks may be connected with a mechanical interface that permits the terrace hinge mechanism 274 to be mounted to the boat hull or other structure of the boat, thus allowing the rotational shaft (and bulwark terrace 208) to rotate relative to the boat hull about the terrace hinge axis 220. The shaft may, in some implementations, include a crank arm 258 that is connected with a linear actuator 246 that may be used to rotate the crank arm 258 and the bulwark terrace 208 between a stowed configuration (as shown in FIG. 10) and an open configuration (as shown in FIG. 9). The linear actuator 246 may be a hydraulic actuator, for example, and may be powered by a hydraulic pump in the boat. In some implementations, the terrace hinge mechanism 274 may also include a secondary slotted crank arm 262 that may have a slotted track or guide that may interface with a backup linear actuator 260. The backup linear actuator 260 may be actuated by a hand pump 264, and may have a linear throw that is larger than that of the linear actuator 246. For example, the backup linear actuator 260 may have a throw that is sufficient to drive the movable end of the backup linear actuator 260 along the slotted track or guide until the movable end of the backup linear actuator 260 bottoms out in the slotted track or guide and pushes the slotted crank arm 262 so that the bulwark terrace 208 rotates into the stowed configuration. This system may be used to return the bulwark terrace 208 to the stowed configuration in the event that the linear actuator 246 fails. When the bulwark terrace 208 is in the stowed configuration, safety interlocks 266 may be extended into receptacles in the bulwark terrace 208 in order to lock the bulwark terrace 208 in place. Generally speaking, the terrace hinge mechanism 274 may be configured to rotate between a first limit of rotation and a second limit of rotation. The first limit of rotation may be associated with the deployed configuration of the bulwark terrace, e.g., be such that the bulwark terrace is nominally horizontal, and the second limit of rotation may be associated with the stowed configuration, e.g., be such that the bulwark terrace is vertical or nearly vertical. The arc through which the bulwark terrace may swing when moving between the two limits may be, for example, between 70° and 120°, depending on the design of the bulwarks (some bulwarks may be vertical, whereas others may flare inward or outward, requiring more or less swing for the bulwark terrace to reach horizontal).

As can be seen, the door 210 in the bulwark terrace 208 may be attached to the bulwark terrace 208 with a door hinge mechanism 270, e.g., a piano hinge, and may, in some implementations, include the extendable boarding ladder 216 and/or a latch mechanism 268.

The inclusion of the door 210 within the bulwark terrace 208 offers a unique combination of features that makes the depicted embodiment, and similar such designs, quite attractive in the small- and medium-sized yacht market. As yachts may dock in a variety of environments, including at raised wharfs and low docks, it may be desirable to include a door in the bulwark to allow for easy passenger embarkation or disembarkation when docked at a low-height facility. At the same time, the same portion of the bulwark may also be used to provide a bulwark terrace when the yacht is at sea (and when the door would typically not be used). By combining the door 210 into the bulwark terrace 208, both features may be offered on a smaller yacht without sacrificing bulwark terrace length. This allows smaller yachts to have amenities that were previously only available on larger yachts.

The bulwarks and bulwark terraces discussed herein may be made from any suitable material, although it is common practice to make similar structures out of molded fiberglass, carbon fiber, or similar composites, as such materials are easily shaped, lightweight, and strong. The bulwark terraces (and the doors, in some implementations) may include an internal structure or framework that may be used to strengthen the bulwark terrace (and door, in some cases); such frameworks may be made from materials such as stainless steel, steel, aluminum, or other higher-strength material. The hinge mechanisms discussed herein may be made from a variety of materials, including stainless steel or other materials suitable for use in a saltwater environment.

It is to be understood that boats, yachts, and ships frequently have graceful, smooth lines, and that bulwarks and hulls may typically include curved or contoured areas. As such, reference may be made herein to "nominal" relationships; it is to be understood that these relationships may be approximate and are not necessarily limited to the exact relationships indicated. For example, a direction that is "nominally parallel" to a bulwark or a section of a bulwark may be viewed as including directions that are tangent, at any point, to the curved path that a bulwark or bulwark section may follow. Similarly, while the term "nominally vertical" may be used to refer to a direction that is perpendicular to the deck, it may also be used to refer to directions within a few degrees of true vertical. For example, bulwarks may generally be described as "nominally vertical" walls, but the reality is that many bulwarks may flare slightly outwards so as to follow the cross-sectional curvature of the hull and preserve the lines of the boat. Such bulwarks may nonetheless be considered to be nominally vertical.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Various features that are described herein in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A boat, the boat comprising:
a hull;
a deck;
a bulwark extending upwards from the deck and extending along a side of the hull;
a bulwark terrace;
a bulwark terrace hinge mechanism;
a door; and
a door hinge mechanism, wherein;
the bulwark terrace is a section of the bulwark that is movable relative to a section or sections of the bulwark adjoining the bulwark terrace,
the bulwark terrace hinge mechanism is configured to allow the bulwark terrace to be pivoted about a terrace hinge axis relative to the section or sections of the bulwark adjoining the bulwark terrace,
the bulwark terrace has a door cutout sized to receive the door,
the door hinge mechanism is configured to allow the door to be pivoted about a door hinge axis relative to the bulwark terrace and between an open configuration and a closed configuration,
the door, in the closed configuration, is positioned in the door cutout, and
the door, in the open configuration, is not positioned in the door cutout.

2. The boat of claim 1, wherein the door hinge axis and the terrace hinge axis, when viewed along a vector defining the shortest distance between the door hinge axis and the terrace hinge axis, define an angle of between 70° and 90°.

3. The boat of claim 1, wherein:
the bulwark terrace hinge mechanism has a first limit of rotation about the terrace hinge axis and a second limit of rotation about the terrace hinge axis,
the first limit of rotation limits the amount of rotation of the bulwark terrace relative to the hull in a first direction,
the second limit of rotation limits the amount of rotation of the bulwark terrace relative to the hull in a second direction opposite the first direction, and
the bulwark terrace has:
an inboard surface that is flush with the deck when the bulwark terrace reaches the first limit of rotation, and
an outboard surface that is flush with an outboard surface or surfaces of the section or sections of the bulwark adjoining the bulwark terrace when the bulwark terrace reaches the second limit of rotation.

4. The boat of claim 3, wherein the door includes a telescoping ladder housed within the door, wherein the telescoping ladder is configured to deploy from a surface of the door that faces upwards when door is in the closed configuration and the bulwark terrace is at the second limit of rotation and that faces outboard when the bulwark terrace is at the first limit of rotation.

5. The boat of claim 1, wherein:
the door, when in the closed configuration, has a width in a direction perpendicular to the door hinge axis and generally parallel to the terrace hinge axis, and
the door cutout is set off from an end of the bulwark terrace closest to the door hinge mechanism by a distance greater than the width of the door and in a direction parallel to the terrace hinge axis.

6. The boat of claim 1, wherein the door hinge axis and the terrace hinge axis are substantially parallel.

7. The boat of claim 6, wherein the door includes one or more features selected from the group consisting of: molded handholds, molded footholds, and a fold-out ladder.

8. The boat of claim 1, wherein the door hinge axis and the terrace hinge axis are within ±20° of parallel.

9. The boat of claim 1, wherein the door is configured to pivot inwards and towards a centerline of the boat when the door is moved from the closed configuration to at least a first open position.

10. The boat of claim 1, wherein the door is configured to pivot outwards and away from a centerline of the boat when the door is moved from a closed position to at least a first open position.

11. The boat of claim 1, wherein the door cutout forms a generally rectangular notch in the bulwark terrace.

12. The boat of claim 1, wherein the door cutout forms a generally rectangular hole in the bulwark terrace.

13. A bulwark terrace assembly, the bulwark terrace assembly comprising:
a bulwark terrace hinge mechanism;
a bulwark terrace;
a door; and
a door hinge mechanism, wherein:
the bulwark terrace hinge mechanism includes one or more stationary mounting features,
the bulwark terrace is connected with the bulwark terrace hinge mechanism such that the bulwark terrace is rotatable about a terrace hinge axis relative to the stationary mounting features,
the bulwark terrace has a door cutout sized to receive the door,
the door hinge mechanism is configured to allow the door to be pivoted about a door hinge axis relative to the bulwark terrace and between an open configuration and a closed configuration,
the door, in the closed configuration, is positioned in the door cutout, and
the door, in the open configuration, is not positioned in the door cutout.

14. The bulwark terrace assembly of claim 13, wherein the door hinge axis and the terrace hinge axis, when viewed along a vector defining the shortest distance between the door hinge axis and the terrace hinge axis, define an angle of between 70° and 90°.

15. The bulwark terrace assembly of claim 13, wherein:
the bulwark terrace has a first limit of rotation about the terrace hinge axis and a second limit of rotation about the terrace hinge axis,
the first limit of rotation limits the amount of rotation of the bulwark terrace relative to the stationary mounting features in a first direction,
the second limit of rotation limits the amount of rotation of the bulwark terrace relative to the stationary mounting features in a second direction opposite the first direction,
the first limit of rotation is associated with a deployed configuration of the bulwark terrace, the second limit of rotation is associated with a stowed configuration of the bulwark terrace, and the bulwark terrace rotates through an arc of between 70° and 120° when transitioning between the first limit of rotation and the second limit of rotation.

16. The bulwark terrace assembly of claim 15, wherein:

the bulwark terrace and the door have inboard surfaces that face the fore-aft centerline of a boat when the bulwark terrace assembly is installed in the boat, the bulwark terrace is in the stowed configuration, and the door is in the closed configuration, and the door is configured to pivot such that the inboard surface of the door and the inboard surface of the bulwark terrace face each other when the bulwark terrace is in the stowed configuration and the door is in the open configuration.

17. The bulwark terrace assembly of claim 15, wherein:

the bulwark terrace and the door have outboard surfaces that face away from the fore-aft centerline of a boat when the bulwark terrace assembly is installed in the boat, the bulwark terrace is in the stowed configuration, and the door is in the closed configuration, and the door is configured to pivot such that the outboard surface of the door and the outboard surface of the bulwark terrace face each other when the bulwark terrace is in the stowed configuration and the door is in the open configuration.

18. The bulwark terrace assembly of claim 13, wherein:

the door, when in the closed configuration, has a width in a direction perpendicular to the door hinge axis and generally parallel to the terrace hinge axis, and the door cutout is set off from an end of the bulwark terrace closest to the door hinge mechanism by a distance greater than the width of the door and in a direction parallel to the terrace hinge axis.

19. The bulwark terrace assembly of claim 13, wherein the door cutout forms a generally rectangular notch in the bulwark terrace.

20. The boat of claim 13, wherein the door cutout forms a generally rectangular hole in the bulwark terrace.

* * * * *